United States Patent [19]

Ohnishi et al.

[11] Patent Number: 4,831,412

[45] Date of Patent: May 16, 1989

[54] COPYING MACHINE

[75] Inventors: Kazuyuki Ohnishi, Nara; Masakiyo Okuda, Kashiwara; Yoshiteru Mori, Osaka, all of Japan

[73] Assignee: Sharp Kabushiki Kaisha, Osaka, Japan

[21] Appl. No.: 3,833

[22] Filed: Jan. 16, 1987

[30] Foreign Application Priority Data

Jan. 18, 1986 [JP] Japan ..... 61-9401

[51] Int. Cl.[4] ..... G03G 21/00

[52] U.S. Cl. ..... 355/233; 355/309

[58] Field of Search ..... 355/3 SH, 8, 14 R, 14 C, 355/14 SH

[56] References Cited

U.S. PATENT DOCUMENTS

| | | | |
|---|---|---|---|
| 4,129,377 | 12/1978 | Miyamoto et al. | 355/14 |
| 4,406,537 | 9/1983 | Mori | 3 SH X/3 X |
| 4,461,564 | 7/1984 | Ikenoue | 355/8 |
| 4,595,286 | 6/1986 | Yamazaki | 355/14 R X |
| 4,607,946 | 8/1986 | Uchiyama et al. | 355/14 R |
| 4,615,611 | 10/1986 | Yoshiura | 355/14 R |
| 4,659,207 | 4/1987 | Maekawa | 355/8 |

FOREIGN PATENT DOCUMENTS

| | | |
|---|---|---|
| 3421255 | 12/1984 | Fed. Rep. of Germany . |
| 3517086 | 11/1985 | Fed. Rep. of Germany . |
| 3606881 | 9/1986 | Fed. Rep. of Germany . |

OTHER PUBLICATIONS

Patent Abstracts of Japan, vol. 9, No. 281, 11/8/85.

European Patent Office Search Report, Appln. No. 87300433.7, dated Jun. 2, 1988.

*Primary Examiner*—Fred L. Braun

*Attorney, Agent, or Firm*—Birch, Stewart, Kolasch & Birch

[57] ABSTRACT

A copying machine for copying an original in the form of a double-spread page placed on an original stand or carriage such that the original is accurately divided when copied onto two sheets of paper. The copying machine includes a control device for controlling a copy start position of an original copy operation by a time difference determined between a reference position timing of an original scanning and a sheet feed start timing, and is operable regardless of a selected magnification.

4 Claims, 8 Drawing Sheets

FIG. 2(A)
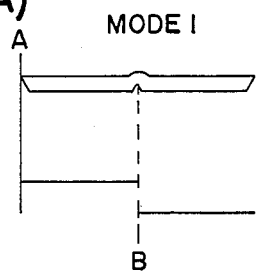
FIG. 2(B)
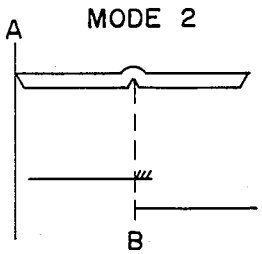
FIG. 2(C)
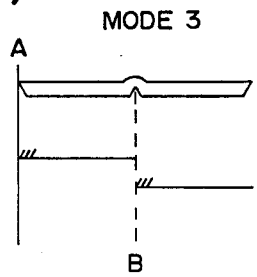
FIG. 2(D)
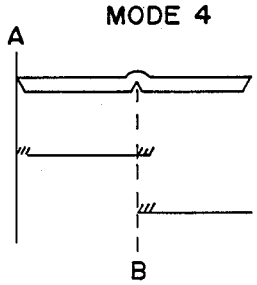
A: Reference Position At End of Carriage
B: Book Placement Reference Position
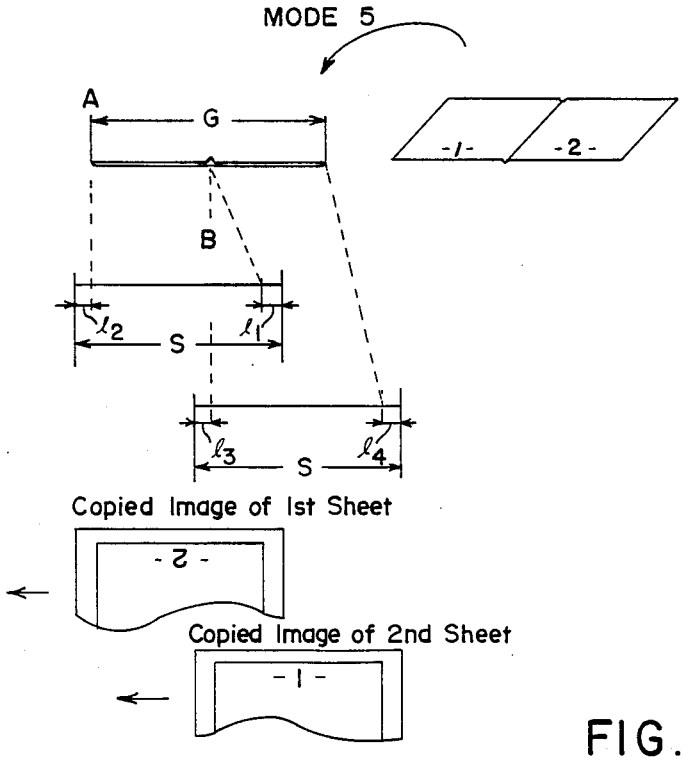
FIG. 2(E)

FIG. 3 (A)
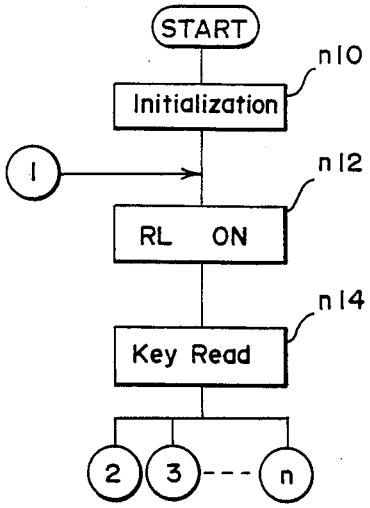
FIG. 3 (B)
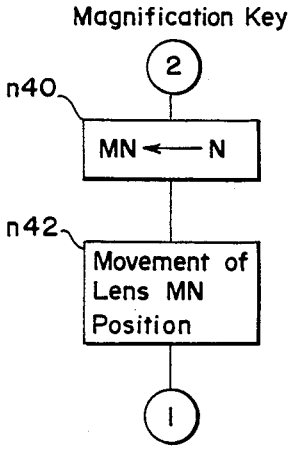
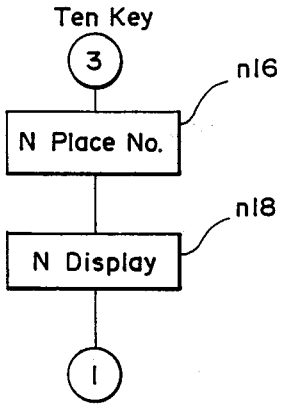
FIG. 3 (C)
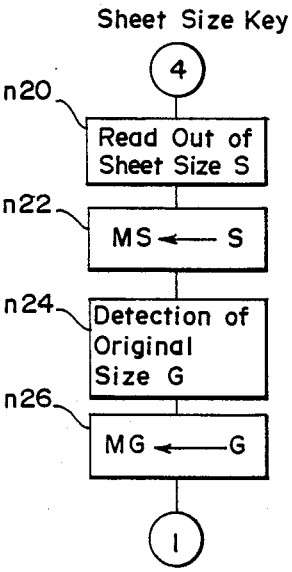
FIG. 3 (D)

COPYING MACHINE

BACKGROUND OF THE INVENTION

This invention relates to a copying machine for copying an original in the form of a double-spread page placed on an original stand or carriage and dividing the original into two sheets of paper.

More specifically, the copying machine according to the present invention is designed so that when an original of a double-spread page placed on an original carriage is copied, a central point of the original size in the original scanning direction is set to a reference position timing of the original scanning irrespective of a copying magnification selected when the second page of the original is copied whereby the original of the double-spread page placed on the carriage may be copied with a suitable copying magnification dividing the original into two sheets.

A copying machine has been known which copies an original of a double-spread page placed on an original carriage dividing the original into two sheets of paper.

This function is effective in the case where an original such as books are copied page by page. However, the copying machine having such a function as just mentioned is inconvenient, when an original of a double-spread page A3 format is intended to be reduced or scaled down approximately 0.9 times to copy it on two sheets of A4 format including a binding margin because the front end of the second page is copied halfway through page 2 of the original.

OBJECT OF THE INVENTION

It is an object of the present invention to provide a copying machine in which even if a copying magnification is voluntarily set, the second page of the original of a double-spread page placed on the carriage may be copied in a predetermined position on the sheet similar to the first page.

According to the present invention, there is provided a copying machine including a copy start position control device for controlling a copying start position of an original by a time difference between a reference position timing of original scanning and a sheet feed start timing 2, an original size detection device for detecting the size of an original placed on an original carriage 2, and a magnification-changing copying device for copying an original with a preset copying magnification. The copying machine for copying an original in the form of a double-spread page placed on the carriage dividing the original into two sheets of paper is characterized in that the copy start position control device includes a reference position timing setting device for the copying of a second page wherein the second page of the original is copied, a central point of the original size detected by the original size detection device in an original scanning direction is set to the reference position timing of original scanning irrespective of the copying magnification.

With the above-described arrangement, when the second page of the original is copied, the central point of the original size in the original scanning direction is set to the reference position timing of original scanning, and therefore a copied image of the second page of the original may be formed in a predetermined position of the sheet.

BRIEF DESCRIPTION OF THE DRAWINGS

The present invention will become more fully understood from the detailed description given herein-below and the accompanying drawings which are given by way of illustration only, and thus are not limitative of the present invention and wherein:

FIGS. 2 (A) to (E) illustrate the copying operation in various modes of the copying machine.

DESCRIPTION OF THE PREFERRED EMBODIMENTS

Figure 1:
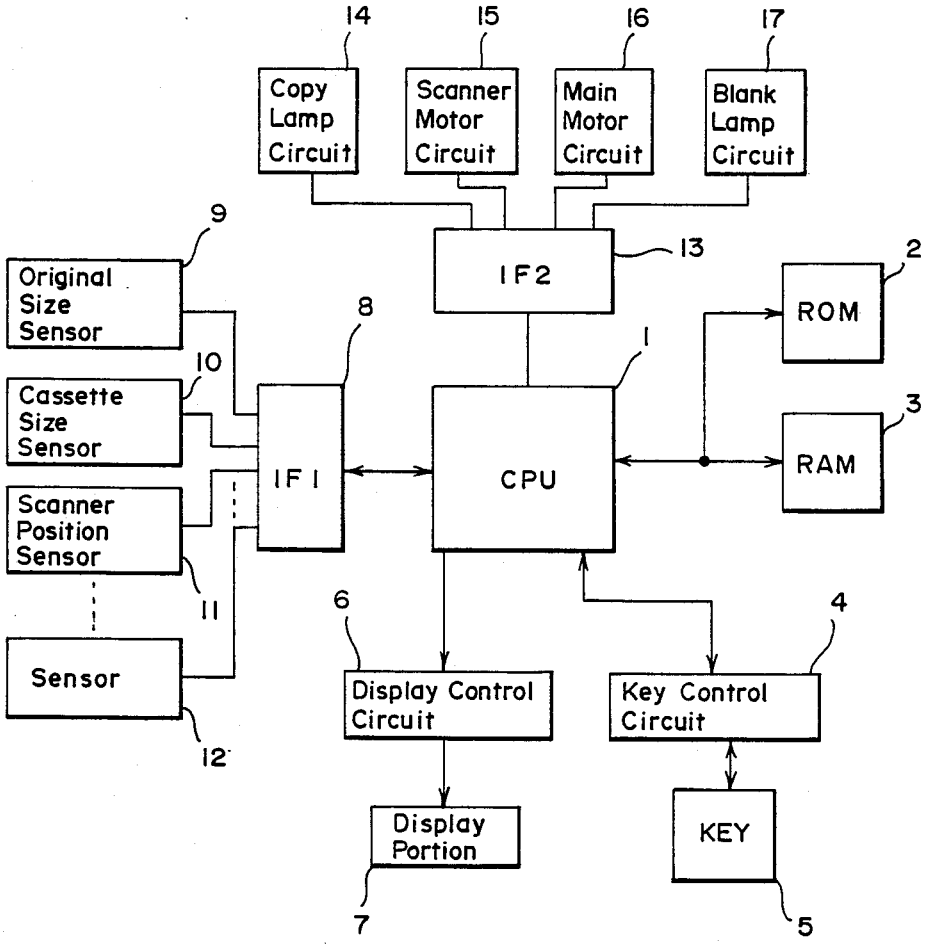
FIG. 1 is a block diagram of a control section of a copying machine embodying the present invention.

FIG. 1 is a block diagram of a control section of a copying machine embodying the present invention.

The overall control is accomplished by program processing of CPU1. The control program is prewritten in ROM2, and RAM3 is used as a working area for various flags, buffers and the like during the execution of the control program.

A key control circuit 4 is a circuit for deciding the operating state of a key input device 5, and the CPU1 reads the content of the operated key from the key control circuit 4. A display control circuit 6 is a circuit for controlling the display of a display portion 7, and the CPU1 outputs data to be displayed to the display control circuit 6 for display thereof.

An original size sensor 9 is a sensor for detecting the size of an original placed on the carriage, the sensor being composed of a plurality of photosensors having a light emitting diode and a phototransistor with an original carriage formed from a glass plate sandwiched therebetween. The CPU1 decides the state of the plurality of photosensors to detect the size of an original placed on the carriage. A cassette size sensor 10 is a sensor for detecting the size of a cassette for sheets of paper attached to an opening to which the cassette is attached, and the CPU1 decides that state to detect the size of a selectable sheet. A scanner position sensor 11 is a sensor for detecting a position of a scanner which scans a lower portion of the carriage, the CPU1 decides the state of the sensor to effect processings such as lighting of a blank lamp, starting of transporting the sheet or the like in a predetermined timing. These and other various sensors 12 (such as a paper detection sensor for detecting whether a copied sheet is ejected out of an outlet) are connected to an interface 8.

Connected to the interface 13 are a circuit 14 for driving a copy lamp for illuminating an original, a circuit 15 for driving a motor for the scanning of a scanner, a circuit 16 for controlling a main motor for driving a photosensitive drum, a roller for transporting sheets and the like, and a circuit 17 for driving a blank lamp for erasing a latent image formed on the surface of a photosensitive member, which are controlled according to signals of CPU1.

FIG. 2 illustrates the operation of various copying modes of the copying machine. A book which is an original in the form of a double-spread page is shown above whereas the area for scanning is shown below corresponding to the position of the original.

In case of Mode 1 shown in FIG. 2(A), the first page and the second page of the original are respectively copied on two sheets. While normally 2 the original is placed on the carriage while being adjusted to a reference position A at the end of the carriage, it is noted that in case the original is of the size smaller than a standard size, the original is placed on the carriage with a central portion thereof adjusted to a book place reference position B.

In case of Mode 2 shown in FIG. 2(B), when the first page of the original is copied, an area shifted by the distance of a hatched portion in the figure is copied. Here, the hatched portion causes the photosensitive member to be photosensed by the blank lamp, and therefore, the front end of the original of the second page is not copied on the first sheet.

In case of Mode 3 shown in FIG. 2(C), an area of each page is copied on two sheets but a front end portion of the sheet and a non-image forming region are erased by the blank lamp. This mode is used to prevent formation of an image with a black line (frame) around a copied image and thereby prevent an unsightly appearance.

In case of Mode 4 shown in FIG. 2(D), which is a combination of the aforesaid Modes 2 and 3, an area slightly shifted from the first page is copied on the first sheet similarly to the case of Mode 2, and a rear end portion of the first sheet is erased by the blank lamp.

In case of Mode 5 shown in FIG. 2(E), a copied image smaller than the size of the respective sheets is copied page by page of the original. As shown, an area not required to be copied is erased by the action of the blank lamp, and a copied image of the first sheet and a copied image of the second sheet as shown below of FIG. 2(E) are formed. The copying according to Mode 5 is effective for the case where an original of a double-spread page such as a gravure, a map or the like is a continuous image, it is copied on the sheet over the entire region and a binding margin is also automatically prepared.

FIG. 3 (A) to (J) are flow charts showing the processing procedure of the aforementioned control portion.

First, when a power source is closed, the contents of a memory are initialized, the initialization of various portions required for the copying process is carried out (n10). Thereafter, a ready lamp indicative of the state that the key operation is possible is turned on to read the key (n12→n14). Thereafter the processing corresponding to the operated key is carried out.

Figure 3E:
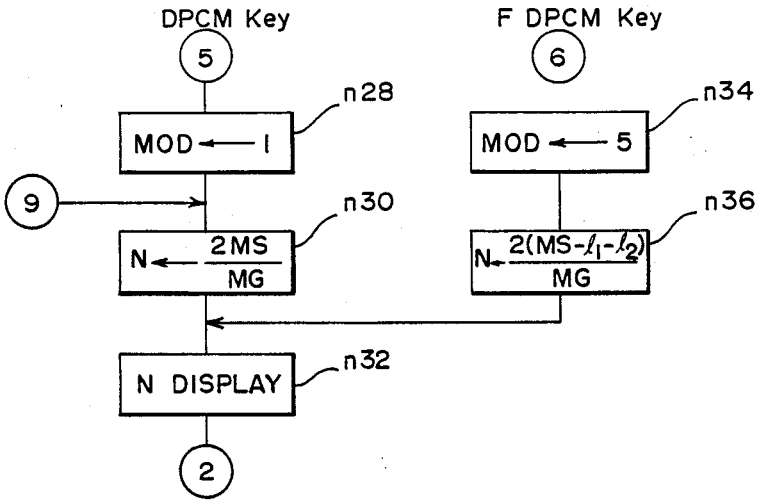
FIGS. 3 (A) to (J) are respectively flow charts showing the processing procedure of the control section.

If the operated key is the ten key, the value of the operated ten key is put into a buffer N as shown in FIG. 3(C) to display it (n16→n18).

If the sheet size key was operated, the size of the sheet cassette attached to the opening to which sheet cassette is attached is switched and read, which is set to a buffer MS (n20→n22). The size of the original placed on the carriage is detected and set to a buffer MG (n24→n26).

If the DPCM key was operated, a register MOD representative of a mode is set to 1, and the copying magnification is obtained as 2MS/MG to display it (n28→n30→n32). This value is set to a buffer MN representative of the copying magnification, and a lens is moved to the position corresponding to the copying magnification as set (n40→n42).

If the FDPCM key is operated, the Mode 5 is set to obtain the copying magnification as 2 (MS−l1−l2)/MG and a lens is likewise moved to the corresponding position (n34→n36→). The copying magnification is set in the manner as described whereby a copied image smaller in size than the sheet size may be formed and the whole region of each page of the original may be formed within the size of the sheet.

Figure 3F:
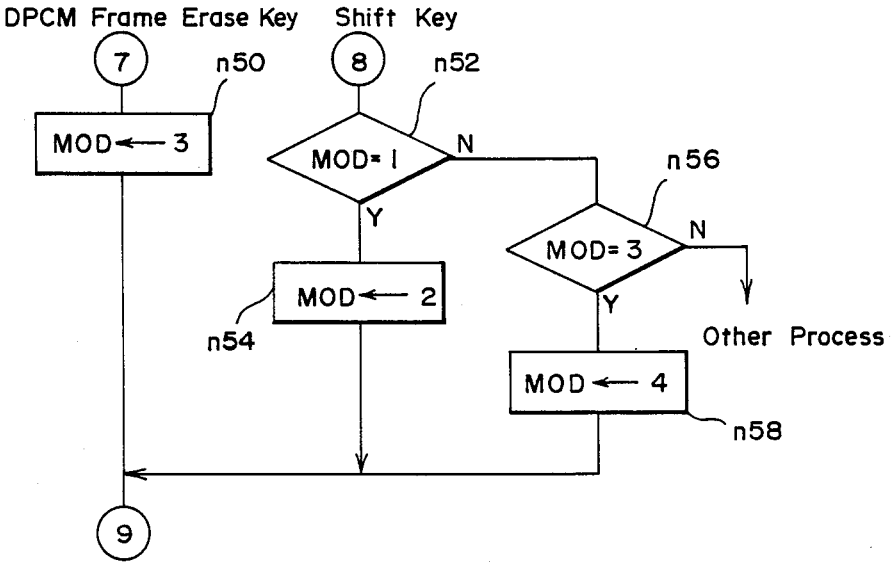
Figure 3G:
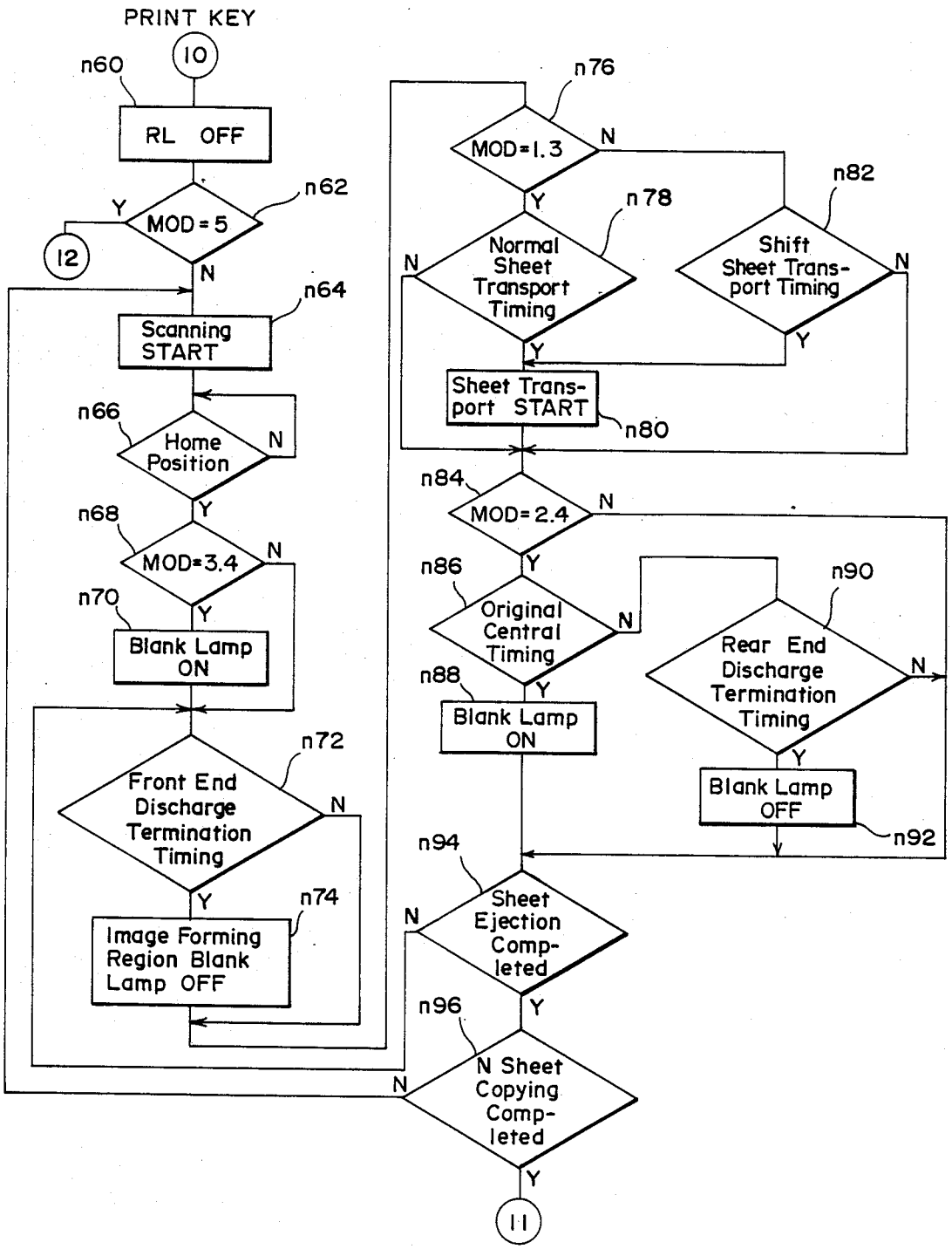

If the operated key is a DPCM key frame erasing key, the Mode 3 is set as shown in FIG. 3(F), and the copying magnification is set likewise the case of the Mode 1 (n50→n30→). If the operated key is a shift key, Mode 1, if it is so, is changed to Mode 2, and Mode 3, if it is so, is changed to Mode 4 (n54, n58).

The selection of the sheet size and assignment of the mode are carried out in the manner as described above.

If the operated key is a print key, the ready lamp is first turned off as shown in FIG. 3(C), and the controlling of the drive of the blank lamp and the start of transporting the sheet is carried out with respective timing shown in FIG. 2 according to the various modes.

In the modes other than the Mode 5, the operator first starts scanning of a scanner and waits until the scanner reaches the home position, i.e., the position corresponding to the reference position A of the end of the carriage shown in FIG. 2 (n64→n66). When the scanner has arrived at the home position and at that time the mode is Mode 3 or Mode 4, the blank lamp is turned on (n70). When a termination timing to be discharged at the front end of the first sheet is reached, the blank lamp for only the image forming region is turned off (n74).

When a normal sheet transport timing at Mode 1 or 3 is reached, the transport of the sheet starts (n76→n78→n80). When the sheet transport timing shifted as shown in FIGS. 2 (B) and (C) at Mode 2 or 4 is reached, the transport of the sheet starts (n82→n80).

In the timing of the central portion of the original at Mode 2 or 4, that is, when the scanner reaches the book place reference position B shown in FIG. 2, the blank lamp is turned on (n84→N86→n88). At the timing when discharging of the rear end of the sheet is terminated, the blank lamp is turned off (n90→n92).

The above-described processing is repeatedly carried out till the copied sheet has been detected to be ejected out of the outlet, so that the predetermined processing is carried out successively in the predetermined timing.

After sheets of the number N set by the ten key have been copied and processed, copying of the second page of the original is carried out.

Figure 3H:
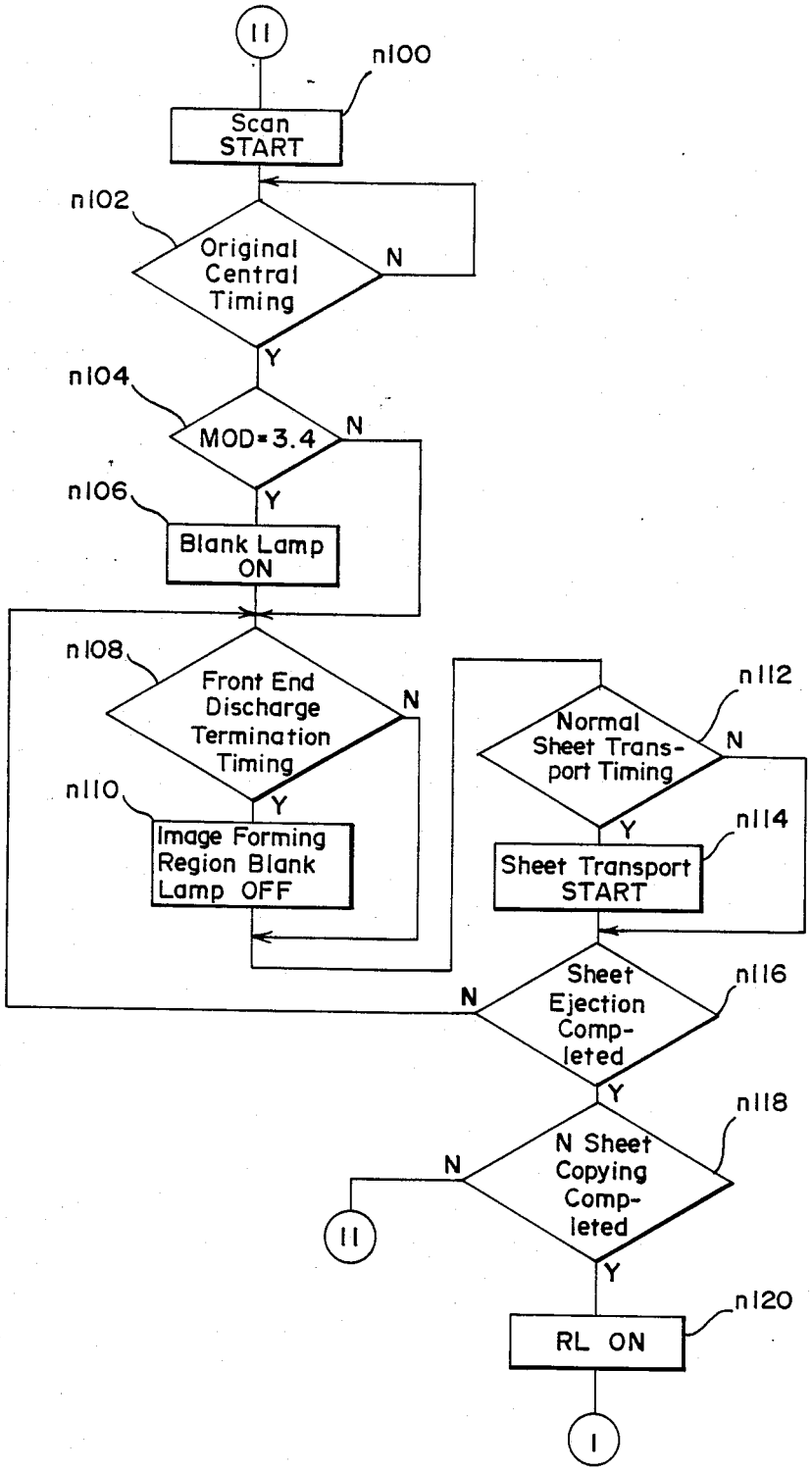

When reaching the central portion of the original after scanning of a scanner has been started, as shown in FIG. 3(H), if the mode is Mode 3 or 4, the blank lamp is turned on (n106). When reaching the discharge termination timing of the front end portion of the sheet the blank lamp for only the image forming region is turned off (n110). When reaching the normal sheet transport timing, the transport of the sheet starts (n112→n114).

The above-described processing is repeatedly carried out till the sheet is ejected out of the outlet, and the control of the blank lamp and the control of the sheet transport start are carried out as shown in FIG. 2.

After sheets of the number N as set have been copied and processed, the ready lamp is turned on to terminate a series of processings according to the print key (n118→n120→).

If in Mode 5, the print key was operated, scanning of a scanner is first started as shown in FIG. 3 (I), and thereafter, when the scanner reached a quick timing by a distance of l2 from the home position A, the blank lamp is turned on (n134), and when the scanner reached the home position, the blank lamp for only the image forming region is turned off (n138).

Thereafter, when reaching the timing at which sheet should be transported, the transport of the sheet starts, and when the scanner reached the central portion B of the original, the blank lamp is turned on (n146). When the scanner reached the position delayed by the distance l1 from the central portion of the original, the blank lamp is turned off (n150).

The detection of timing and the processing of operation according to the timing as described above are carried out till the sheet is ejected, and copying of sheets of the number N as set is repeatedly carried out.

Thereafter, the second page of the original is subjected to copy processing.

Figure 3I:
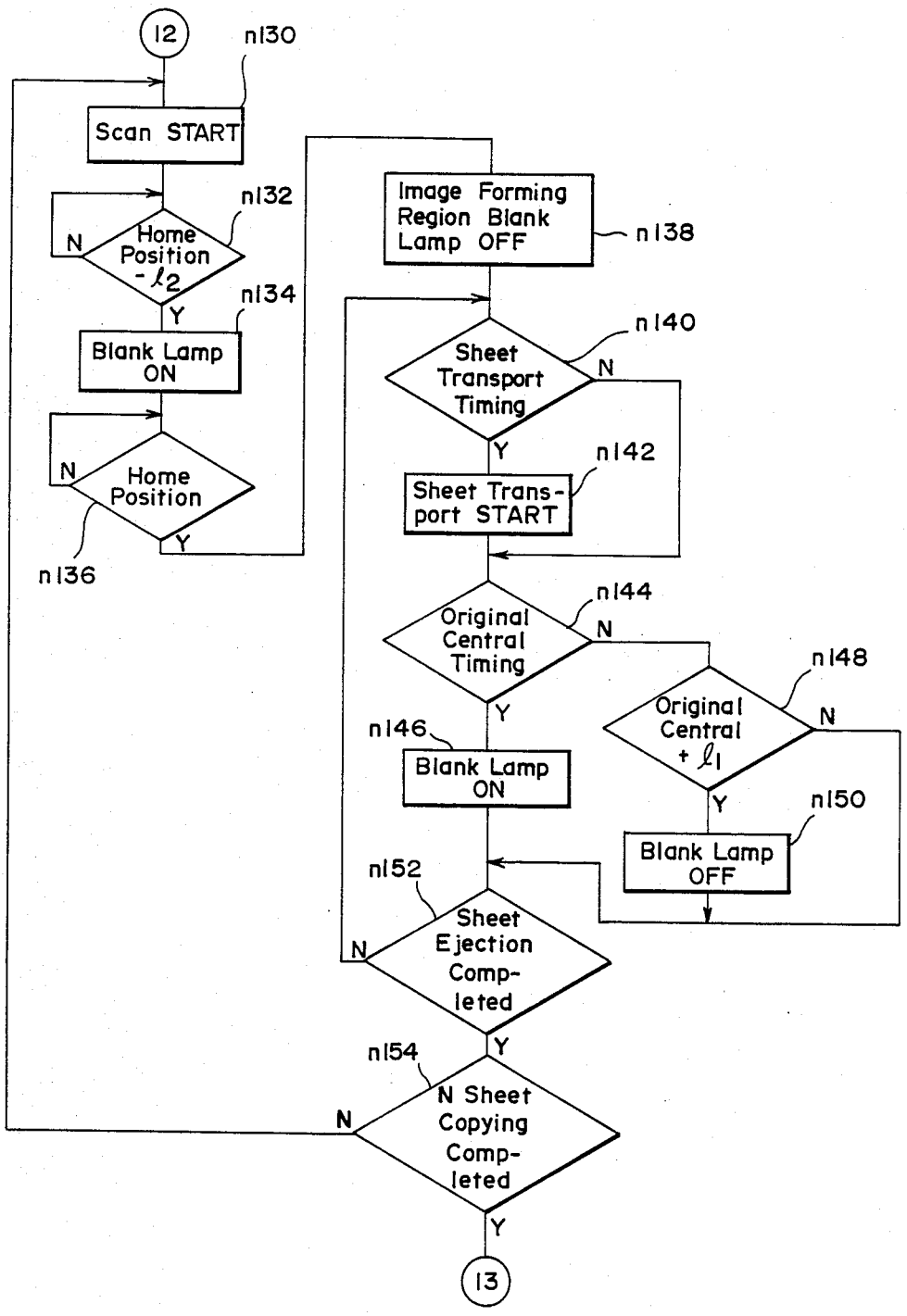
Figure 3J:
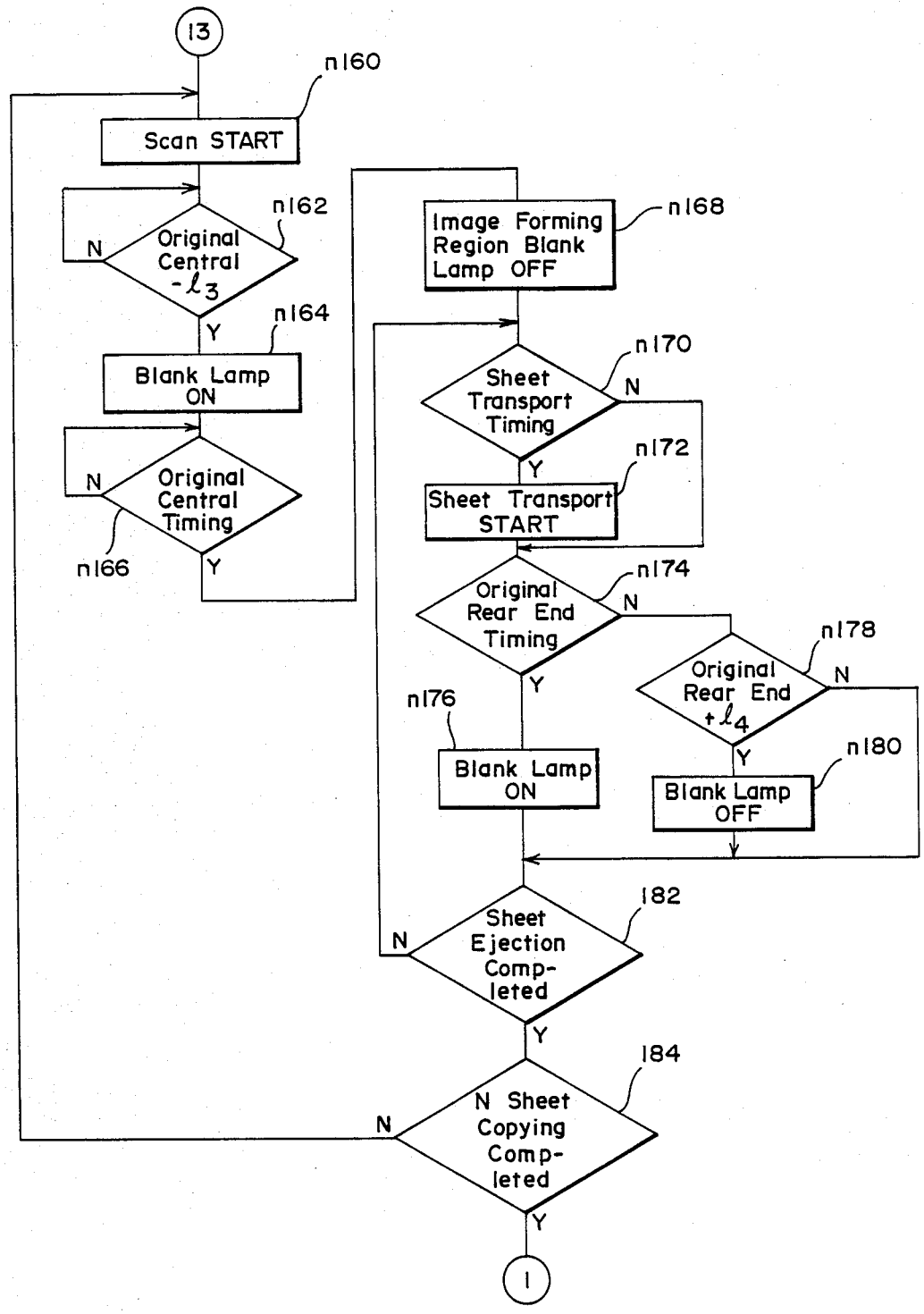

More accurately, the processing as shown in FIG. 3(J) is carried out for erasure of the front end portion of the sheet, when the scanner reaches this side by the distance l3 from the central portion of the image, the blank lamp is turned on (n164) and when the scanner reaches the central portion of the original, the blank lamp for only the image forming region is turned off (n168), which process is different from FIG. 3(I). Furthermore, when the scanner reaches the rear end portion of the original, the blank lamp is turned on (n176), and when the scanner moves forward by the distance l4 from the rear end portion of the original, the blank lamp is turned off (n180).

In the manner as described above, the on and off control of the blank lamp and the control of sheet transport are carried out with the central point in the scanning direction of the original set as a reference position timing of original scanning irrespective of the copying magnification at the time of copying two pages of the original. Thereby, the original of the first page and the original of the second page may be copied on the first sheet and second sheet, respectively, in their respective regions.

While in the above-described embodiment, the size of the original has been automatically detected to determine the central point of the original size in the scanning direction of the original, it is to be noted that where an original of a non-standard size is placed on the carriage with a reference position at the end of the carriage set as a reference, the ten key is used to externally input the original size so that the center point of the original size in the scanning direction of the original may be obtained by arithmetic operation.

While only certain embodiments of the present invention have been described, it will be apparent to those skilled in the art that various changes and modifications may be made therein without departing from the spirit and scope of the present invention as claimed.

What Is claimed Is:

1. A copying machine for controlling a copy start position of a scanning device for a double-spread original placed on a carriage, whereby said original is copied onto two sheets of copy paper, said copying machine comprising:

an original size detection device for detecting the size of the original placed on the carriage;

means, responsive to said original size detection device, for determining the central point of said double-spread original;

a magnification selection device for enabling the original to be copied in a plurality of magnifications;

a copy start position control device for controlling the copy start position of the scanning device for each half of said double-spread original;

a reference position timing setting device, operable with said copy start position control device, to maintain a reference position for beginning copying of the second half of said double-spread original regardless of the copy magnification selected, whereby both halves of said original are accurately copied onto separate sheets of copy paper.

2. The copying machine according to claim 1, wherein said original size detection device includes a plurality of photosensors arranged along the lengthwise direction of the original carriage.

3. The copying machine according to claim 1, wherein said reference position timing setting device includes said means for determining the central point of the original.

4. The copying machine according to claim 1, wherein said copy start position control device controls the copy start position of the original by determining a time difference between a scanning of the original and a copy sheet-feed starting time for both halves of the original, wherein said reference position timing setting device enables said copy start position control device to copy the second half of the original by utilizing the central reference point determined, regardless of the copying magnification selected.

* * * * *